United States Patent [19]

Haytayan

[11] Patent Number: 4,821,938

[45] Date of Patent: Apr. 18, 1989

[54] POWDER-ACTUATED FASTENER DRIVING TOOL

[76] Inventor: Harry M. Haytayan, 32 Indian Rock Rd., Nashua, N.H. 03063

[21] Appl. No.: 125,392

[22] Filed: Nov. 25, 1987

[51] Int. Cl.[4] ..... B25C 1/14

[52] U.S. Cl. ..... 227/10; 227/120; 227/125

[58] Field of Search ..... 227/8, 9, 10, 11, 120, 227/125, 130, 132

[56] References Cited

U.S. PATENT DOCUMENTS

| | | | |
|---|---|---|---|
| 3,168,744 | 9/1965 | Kvavle | 227/10 |
| 3,499,590 | 10/1970 | Bayer et al. | 227/10 |
| 3,552,625 | 5/1971 | Udert | 227/10 |
| 3,554,425 | 12/1971 | Oesterle | 227/10 |
| 3,565,313 | 2/1971 | Seghezzi et al. | 227/10 |
| 3,670,942 | 6/1972 | Pomeroy | 227/10 |
| 3,679,118 | 7/1972 | Maier et al. | 227/10 |
| 3,743,159 | 3/1973 | Schneider | 227/10 |
| 3,860,161 | 1/1975 | Engstrom et al. | 227/10 |
| 3,952,398 | 4/1976 | Haytayan | 227/130 X |
| 3,991,925 | 11/1976 | Büchel | 227/10 |
| 4,040,554 | 9/1977 | Haytayan | 227/130 X |
| 4,051,990 | 10/1977 | Chromy et al. | 227/10 |
| 4,122,904 | 10/1978 | Haytayan | 227/130 X |
| 4,196,833 | 8/1980 | Haytayan | 227/8 |
| 4,346,831 | 4/1982 | Haytayan | 227/8 |
| 4,463,888 | 8/1984 | Geist et al. | 227/125 X |
| 4,655,380 | 4/1987 | Haytayan | 227/9 |
| 4,687,126 | 8/1987 | Brosius et al. | 227/10 |
| 4,741,467 | 5/1988 | Glassner et al. | 227/10 X |

FOREIGN PATENT DOCUMENTS

| | | |
|---|---|---|
| 2223160 | 11/1973 | Fed. Rep. of Germany . |
| 2405743 | 8/1975 | Fed. Rep. of Germany . |

*Primary Examiner*—Paul A. Bell

*Attorney, Agent, or Firm*—Schiller, Pandiscio & Kusmer

[57] ABSTRACT

A powder-actuated fastener-driving tool of the type disclosed in U.S. Pat. No. 4,655,380, modified to include a safety system for preventing accidental discharge of the tool, a fastener storage and feed assembly, and a simpler firing pin assembly. The safety system prevents discharge of a fastener from the tool except when the front of the tool is engaged with a workpiece and the cylinder assembly is urged rearwardly a selected distance into the housing of the tool. The fastener storage and feed assembly is adapted to store a strip of fasteners and to index the strip so as to position the leading fastener in the strip in position to be discharged from the tool. In the present invention, a unitized firing pin is provided for firing the cartridges used in the tool, instead of the plural-element firing actuator and pin assembly of the '380 tool.

11 Claims, 6 Drawing Sheets

POWDER-ACTUATED FASTENER DRIVING TOOL

FIELD OF THE INVENTION

This invention relates to fastener-driving tools in general, and more particularly to powder-actuated fastener-driving tools.

BACKGROUND OF THE INVENTION

Fastener-driving tools are well known in the art. Such tools can generally be classified into two broad classes of tools, based on their source of driving power. The first class of tools, sometimes referred to as fluid-powered fastener-driving tools, depend on the use of pressurized fluids (e.g., air) to provide their driving power. Such tools are exemplified by the following U.S. Pat. Nos. 3,952,398, 4,040,554, 4,122,904, 4,196,833 and 4,346,831. The second class of tools, sometimes referred to as powder-actuated fastener-driving tools, depend on the use of explosive cartridges to provide their driving power. Such tools are exemplified by the following U.S. Pat. Nos. 3,168,744, 3,499,590, 3,552,625, 3,554,425, 3,565,313, 3,743,159 and 4,655,380.

The powder-actuated fastener-driving tool described in U.S. Pat. No. 4,655,380 (the "'380 tool") overcomes many of the problems associated with the powder-actuated fastener-driving tools described in the other aforementioned patents. Two problems have been determined to still exist, however, with respect to the '380 tool.

First, fasteners must be inserted individually into the barrel of '380 patent tool. This individual insertion of fasteners is relatively slow and burdensome.

Second, the firing mechanism of the '380 tool is relatively costly to manufacture due to the relatively large number of moving parts used in the mechanism.

OBJECTS OF THE INVENTION

Accordingly, the principal object of the present invention is to provide a powder-actuated fastener-driving tool which is specifically adapted to avoid the foregoing problems which are associated with the prior art tools, including the '380 tool.

More specifically, one of the objects of the present invention is to provide a powder-actuated fastener-driving tool having a two-part safety mechanism in which a fastener cannot be discharged from the tool except when the front of the barrel of the tool is engaged with a surface and the cylinder of the tool is urged rearwardly a selected distance into the housing of the tool, and in which the safety mechanism cannot be readily defeated.

Another object of the present invention is to provide a powder-actuated fastener-driving tool of the type disclosed in U.S. Pat. No. 4,655,380 in which a preselected number of fasteners can be stored, fed and automatically discharged from the tool so as to avoid the need to load fasteners individually into the tool.

Yet another object of the present invention is to provide a powder-actuated fastener-driver tool of the type disclosed in U.S. Pat. No. 4,655,380 in which the construction of the tool's firing mechanism is simplified as compared to the firing mechanism of the '380 patent tool.

SUMMARY OF THE INVENTION

These and other objects of the present invention are achieved by a powder-actuated fastener-driving tool of the type disclosed in U.S. Pat. No. 4,655,380 (the "'380 tool"), modified to include the following improvements which are not dependent on one another. First, the barrel and cylinder assembly of the '380 tool is modified to include a shaft assembly that extends from a position slightly forward of the firing pin actuator push rod, when the latter is in the forwardly biased position, to a position slightly forward of the front end of the barrel assembly. The shaft assembly is sized and positioned so that the firing pin actuator cannot be biased rearwardly to the position where the actuator latch is aligned with the trigger projection unless (a) the portion of the shaft assembly that extends forwardly of the barrel is urged into the barrel so as to be flush with the front thereof and (b) the barrel and cylinder assembly is urged rearwardly a selected distance into the tool housing. As the powder cartridges used in the tool cannot be discharged except when the firing pin actuator latch is aligned with the trigger projection, and such alignment cannot be achieved except when the two-step process of urging both the shaft assembly and barrel and cylinder assembly rearwardly is performed, as described above, the present invention includes an effective safety interlock system for preventing the accidental discharge of fasteners.

A second improvement over the '380 tool consists of the addition of a fastener storage and feed assembly. The assembly is attached to the front of the cylinder member of the tool and is adapted to store a strip of fasteners and to automatically incrementally feed single fasteners from the strip into the barrel so that the piston member can engage and drive the fastener out of the tool. The storage and feed assembly comprises a constant force spring for urging the fastener strip up toward the barrel of the tool.

A third improvement involves modifying the firing mechanism and the breech block of the '380 tool so as to provide a unitized firing pin that directly contacts and rim fires a cartridge positioned in the firing position, rather than contacting a separate firing pin assembly as in the '380 tool.

BRIEF DESCRIPTION OF THE DRAWINGS

Still other objects and features of the present invention will be more fully disclosed or rendered obvious in the following detailed description of the invention, which is to be considered together with the accompanying drawings, wherein like numbers refer to like parts and further wherein.

DETAILED DESCRIPTION OF THE INVENTION

Figure 1:
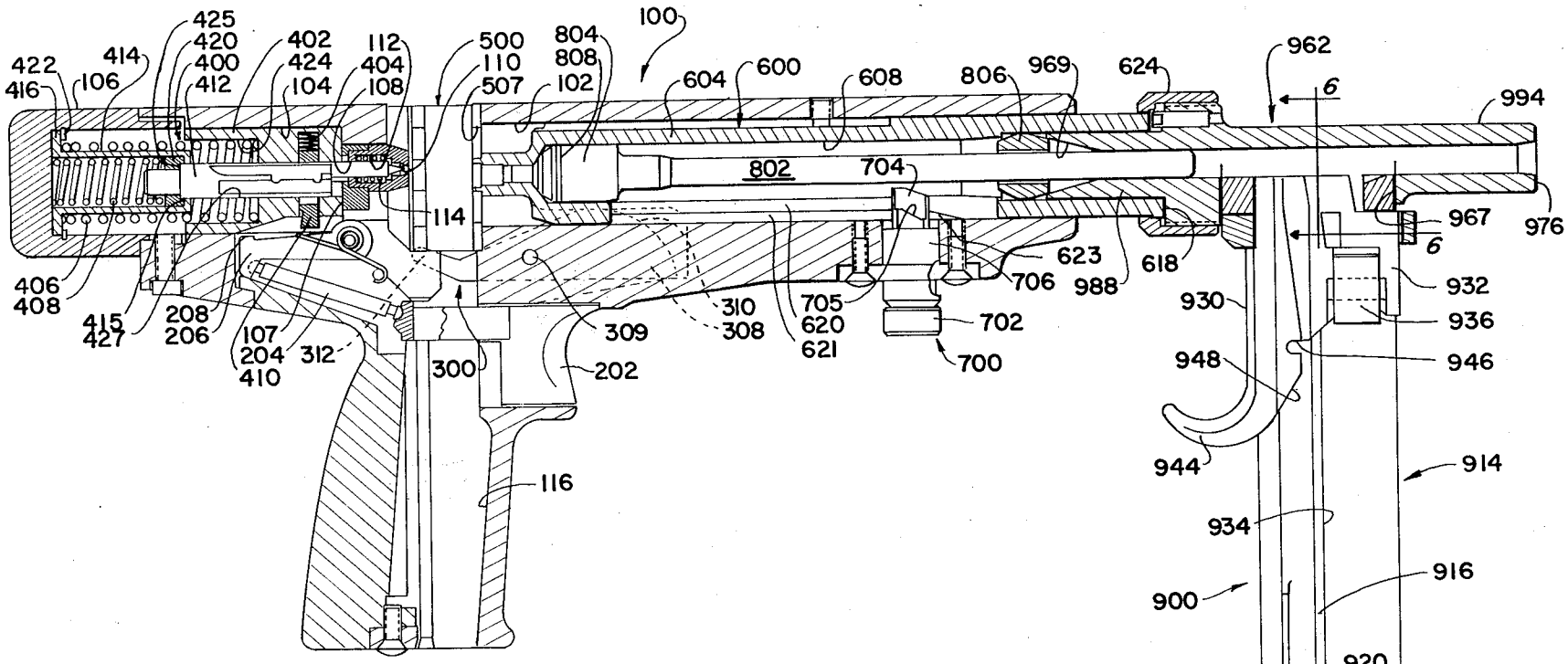
FIG. 1 is a longitudinal sectional view in side elevation, with certain portions shown in cross section and certain portions shown broken away, of the powder-actuated fastener-driver tool of the present invention.

The present invention is an improved version of the powder-actuated fastener-driver tool described in U.S. Pat. No. 4,655,380, which patent is incorporated herein by reference. Referring to FIG. 1, the present invention comprises housing 100, trigger assembly 200, cartridge advance mechanism 300, firing pin mechanism 400, breech block 500, cylinder assembly 600, cylinder stop 700, piston driver member 800, barrel 962 and fastener feed assembly 900. As described in detail below, the improvements to the '380 tool forming the basis of the present invention include simplifying the construction of the firing pin mechanism 400 and breech block 500, modifying cylinder assembly 600 to include a safety interlock in connection with barrel assembly 962, and adding fastener feed assembly 900 to barrel 962. Housing 100, trigger assembly 200, cartridge advance mechanism 300, cylinder stop 700 and piston member 800 are substantially identical to the corresponding elements of the '380 tool. Description of these common elements is provided only to the extent necessary to appreciate the improvements constituting the present invention. A more complete description of these common elements is provided in the aforementioned U.S. Pat. No. 4,655,380.

Figure 2:
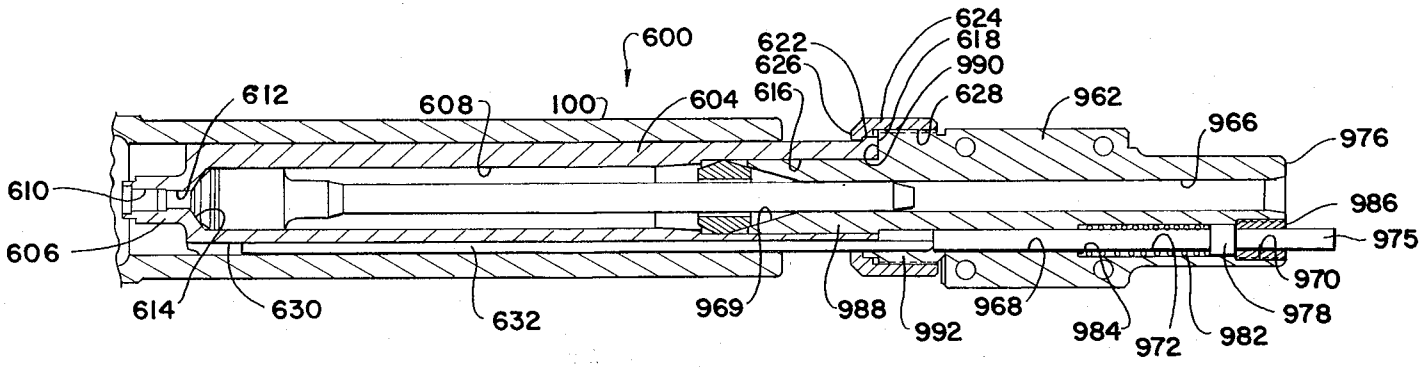
FIG. 2 is a longitudinal cross sectional view of a front portion of the tool taken at a right angle to FIG. 1.

As illustrated in FIGS. 1 and 2, housing 100 includes a front bore 102 that is sized to receive cylinder assembly 600 with a tight sliding fit. A rear bore 104 provided in the rear portion of housing 100 is sized to receive portions of firing pin mechanism 400, as described below. Cap 106 is releasably attached to the end of housing 100 so as to releasably seal off and enlarge the length of rear bore 104. The front end of rear bore 104 terminates at housing wall 107.

An interior bore 108 (FIG. 1) is provided in housing 100 between firing pin mechanism 400 and breech block assembly 500. Front portion 110 of bore 108 tapers conically inwardly toward breech face plate assembly 500. A counterbore 112 is provided in the middle portion of interior bore 108. Compression spring 114 is captivated within counterbore 112 between the shoulders defining the opposing ends of the counterbore. An aperture 116 is provided in the handle portion of housing 100 for receiving a strip of cartridges, as described hereinafter.

Trigger assembly 200 is substantially identical to the trigger assembly of the '380 tool. Referring to FIG. 1, trigger assembly 200 comprises trigger 202, trigger push rod 204, release lever 206, and release lever protrusion 208. As described in detail in the '380 patent, trigger elements 202–208 cooperate so that when trigger 202 is depressed, release lever protrusion 208 is driven upwardly. For a more complete description of the trigger assembly 200, attention is directed to the '380 patent.

Figure 3:
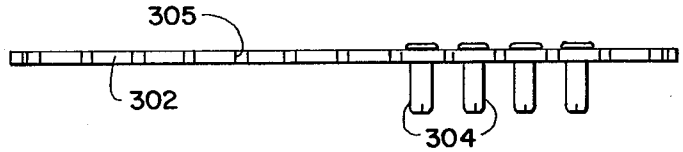
FIG. 3 is a side elevation of a cartridge-supporting strip used in conjunction with the present tool.

Cartridge advance mechanism 300 is identical to the cartridge advance mechanism of the '380 tool. Referring to FIGS. 1 and 3, cartridge advance mechanism 300 is provided for advancing a strip 302 of cartridges 304. Strip 302 includes notches 305 (FIG. 3) on the peripheral edges of the strip. Cartridge advance mechanism 300 comprises strip feed cam 308 which is pivotally attach to housing 100 via pin 309 (FIG. 1) and includes cam surface 310 and finger 312. As described in detail in the '380 patent, cam 308 is formed and positioned so that when cylinder assembly 600 is driven forwardly, a rear portion of cylinder assembly 600 will contact cam 308 causing the latter to pivot, thereby allowing finger 312 to engage another notch 305 on strip 302. When cylinder assembly 200 is urged rearwardly into front bore 102, a rear portion of assembly 600 engages cam surface 310 causing cam 308 to pivot so that finger 312 attached thereto is driven upwardly. By this pivoted movement, cam finger 312 drives cartridge strip 302 upwardly so as to position the leading cartridge in strip 302 in breech block assembly 500 for firing. For a more complete description of cartridge advance mechanism 300, attention is directed to the '380 patent.

Figure 4:
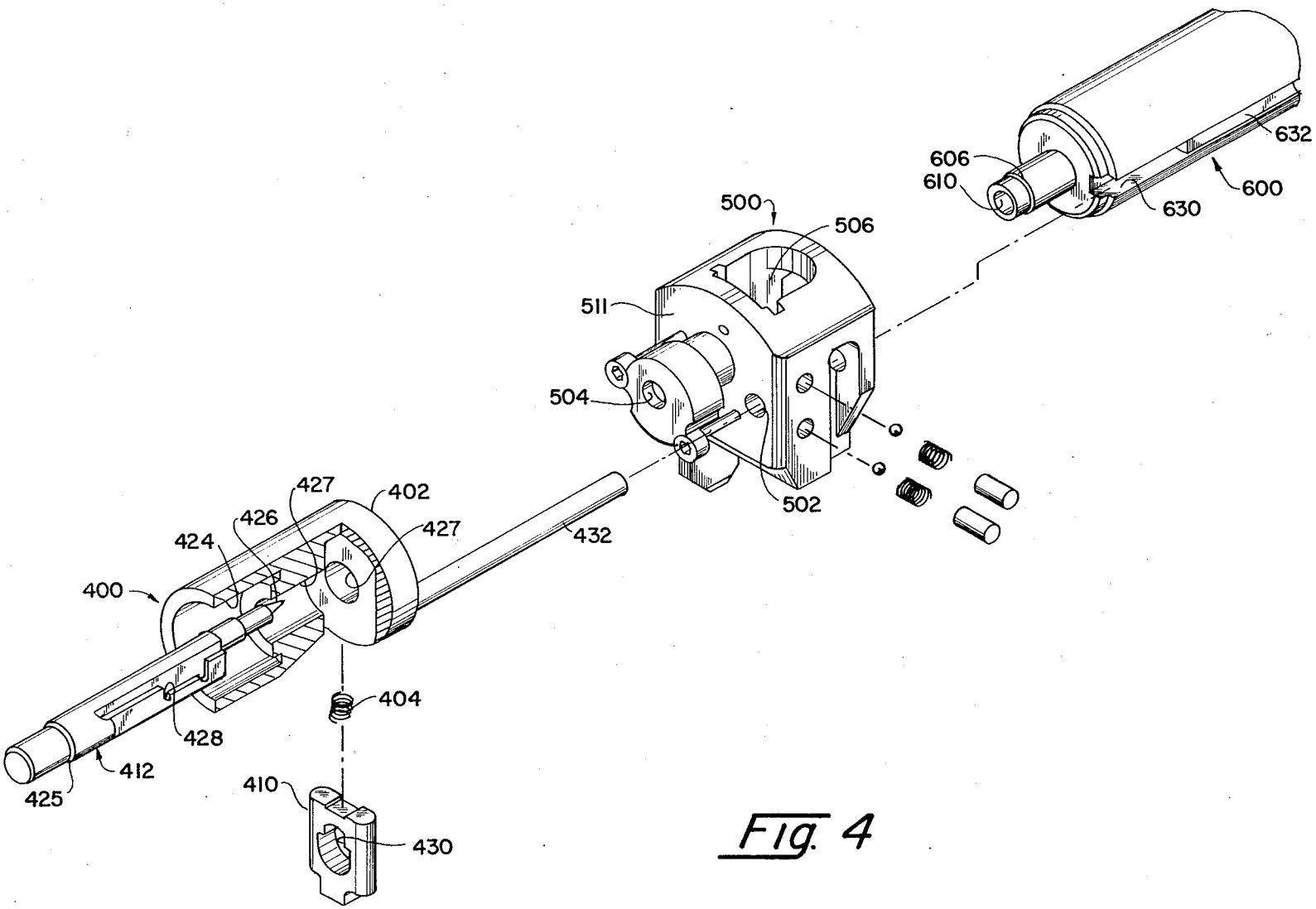
FIG. 4 is an exploded perspective sectional view of portions of the tool's firing pin actuator, breech block and cylinder assembly.

Referring next to FIGS. 1, 2 and 4, firing pin mechanism 400 and breech block assembly 500 are slightly different than the corresponding elements of the '380 tool. As described below, these differences include eliminating the separate firing pin and associated support bracket in the breech block of the '380 tool and adding a point to the front end of the firing pin actuator of the '380 tool so as to permit the firing pin actuator, henceforth referred to the unitized firing pin, to directly contact and rim fire a cartridge.

Firing pin mechanism 400 includes housing 402, three compression springs 404, 406 and 408, a latch or key release 410, a unitized firing pin 412 having a pointed front end 426 (FIG. 4), a spring retaining sleeve 414 having an internal front flange 415 and an external rear flange 416, and a washer 420. Firing pin mechanism housing 402 is disposed for slidable movement in rear bore 104. Spring retaining sleeve 414 is locked to rear cap 106 by a retaining ring 422. Spring 406 surrounds the outer surface of spring retaining sleeve 414 and extends into an interior groove 424 in housing 402. Spring 406 forces firing pin housing 402 away from rear cap 106 and against housing wall 107. Spring 408 forces washer 420 away from rear cap 106 and against the flange 415 of spring retaining sleeve 414.

Unitized firing pin 412 is disposed so that its rear end enters spring retaining sleeve 414 and its shoulder 425 is engaged by washer 420, while its pointed forward end 426 projects through reduced diameter bore 427 (FIGS. 1 and 4) in housing 402 and housing bore 108 and into conically-tapered portion 110. The length of unitized firing pin 412 is chosen so that its pointed front end 426 will extend through breech block aperture 504 (FIG. 4) into the interior of breech block 500 when unitized firing pin 412 is driven forwardly, as noted below. Unitized firing pin 412 is formed with a pair of oppositely disposed notches 428. Unitized firing pin 412 is designed to make a close sliding fit through a key-shaped opening 430 in latch 410.

As described in detail in the '380 patent, except when latch 410 is urged upwardly against the bias of compression spring 404, the forward movement of unitized firing pin 412 is limited by the engagement of firing pin notches 428 with latch 410. Thus, because latch 410 can be urged upwardly only when positioned above trigger protrusion 208, firing pin point 426 can be driven forwardly into breech block 500 to fire a cartridge 304 only when housing 402 is urged rearwardly so as to align latch 410 with protrusion 208.

Push rod 432 (FIG. 4) is attached to housing 402 and extends forwardly through an aperture (not shown) in housing rear wall 107 and bore 502 (FIG. 4) in breech block assembly 500 into front bore 102. The length of push rod 432 is selected so that the push rod will extend a predetermined distance into front bore 102 when actuator housing 402 is biased forwardly into contact with housing wall 107. As viewed from the front of the tool of the present invention at a plane extending normally to the longitudinal axis of front bore 102, push rod 432, and the apertures through which it extends, are positioned at the 9 o'clock position inside the profile of front bore 102 adjacent the inner surface thereof. As firing pin housing 402 is sized for slidable movement in rear bore 104, by urging push rod 432 rearwardly toward housing cap 106, housing 402 is driven rearwardly within rear bore 104.

Breech block assembly 500 is similar to the breech block assembly of the '380 patent, except that firing pin point 426 extends through breech face plate bore 504 (FIG. 4) to contact and fire a cartridge 304 positioned in breech block chamber 506 (FIG. 4) in front of bore 504, rather than to contact and drive forward a separate firing point that contacts and fires the cartridge, as in the '380 tool. As shown in FIG. 1, the front side of the breech face plate has a large circular opening 507 to allow the rear end of the cylinder to be pushed up close to, but spaced from, the rear wall 511 of the breech face plate. The diameter of circular opening 507 is slightly less than the outside diameter of cylinder member 604 so that when the latter is pushed against the front side of breech block 500, the rear end of the cylinder member will close off opening 507. As noted above, breech block assembly 500 also comprises bore 502 extending entirely through the assembly in parallel with bore 504. Bore 502 is sized and positioned to slidably receive push rod 432 so that the latter can be reciprocated in bore 502, as described hereinafter. For a more complete description of breech block assembly 500, attention is directed to the '380 patent.

Continuing to refer to FIGS. 1, 2 and 4, cylinder assembly 600 comprises a cylinder member 604 which has a small diameter tubular extension 606 (FIG. 2) at its rear end and has a generally cylindrical exterior surface. Cylinder member 604 has a coaxial bore 608 that has a first small diameter section 610 (FIG. 2) commencing at the end of tubular extension 606, a second slightly smaller diameter section 612 (FIG. 2) for the remainder of tubular section 606, a frusto-conical transition section 614, and a large diameter counterbore 616 adjacent front end 618 of cylinder member 604. Longitudinally-extending slot 620 (FIG. 1) is provided in cylinder member 604. Slot 620 extends fully through the side wall of the cylinder member. The cylinder member also is grooved at both sides of slot 620 so as to form a shoulder 621 (FIG. 1) at each side that is flat along its length except that its forward end is curved out to the outer surface of the cylinder as shown at 623 (FIG. 1). Slot 620 and shoulder 621 coact with a cylinder stop pin 704, as described hereinafter.

Flange 622 (FIG. 2) is provided at cylinder member front end 618. Flange 622 protrudes slightly from the outer surface of cylinder member 604. Collar 624 surrounds and is sized for slidable and rotatable movement along the outer surface of cylinder member 604. Collar 624 includes shoulder 626 (FIG. 2) that is configured to engage flange 622. By this engagement, collar 624 is prevented from being removed from the front end of cylinder member 603. Bore 628 of collar 624 is threaded.

As best illustrated in FIG. 4, a longitudinally-extending U-shaped groove 630 is provided in cylinder member 604. Groove 630 extends along the entire length of member 604. Groove 630 is positioned in selected circumferential relationship with longitudinally-extending slot 620, so that when cylinder assembly 600 is positioned in housing bore 102 with cylinder stop pin 704 extending into slot 620, groove 630 will be axially aligned with breech block bore 502. Groove 630 is sized to receive an end portion of push rod 432, with the length of the latter being selected so that the push rod extends through bore 502 and into the rearward-most portion of slot 630.

A flat shaft or rod 632 is disposed in groove 630 and is sized so as to be slidable along the length of the slot. The length of shaft 632 is selected so that when actuator housing 402 of firing pin mechanism 400 contacts housing wall 107, and the rearward-most portion of shaft 632 is positioned to contact the forward-most portion of push rod 432, the forward-most portion of shaft 632 will extend a selected distance past the front end 618 of cylinder member 604.

Referring next to FIG. 1, cylinder assembly 600 is slidably retained inside housing bore 102 using cylinder stop assembly 700. The latter is substantially identical to the corresponding assembly in the '380 patent. Cylinder stop assembly 700 comprises knob 702 secured to cylinder stop pin 704. The inner end of pin 704 is reduced in size so that it can extend through slot 620 into cylinder bore 608, and also so as to form a shoulder 705 on each side of the pin. Shoulders 705 ride on shoulders 621 and thus limit penetration of the stop pin into the center bore 608 of the cylinder. When shoulders 705 and 621 are mutually engaged, and the cylinder is pushed into the housing, curved positions 623 of shoulders 621 will coact with shoulders 705 to push the stop pin outwardly far enough to prevent it from intercepting the piston head 804 when the latter is driven forward away from the breech block.

Stop pin 704 is slidably mounted in a sleeve 706 secured to housing 100 and a compression spring (not shown) is disposed in sleeve 706 normally urges stop pin 704 into slot 620. By pulling down on knob 702, against the bias of the compression spring, stop pin 704 is disengaged from slot 620, thereby permitting cylinder assembly 600 to be removed from housing bore 102. Stop pin 704 cooperates with slot 620 to limit the rotational and axial movement of cylinder assembly 600. For a more complete description of cylinder stop assembly 700, attention is directed to the '380 patent.

Referring to FIGS. 1 and 2, a piston driver member 800 is disposed in cylinder bore 608. Driver member 800 is provided for driving a fastener out of the fastener feed assembly 900 and into a suitable workpiece. Driver member 800 is substantially identical to the corresponding driver member disclosed in the '380 patent, to which attention is directed for a complete description of the piston member. Briefly, driver member 800 comprises a driver shaft 802, a piston head 804 and shock collar 806. Shaft 802 extends through and makes a close sliding fit with shock collar 806. Keeper ring 808 located in a groove in the outer surface of piston head 804 make a tight sliding fit with cylinder bore 608.

Figure 9:
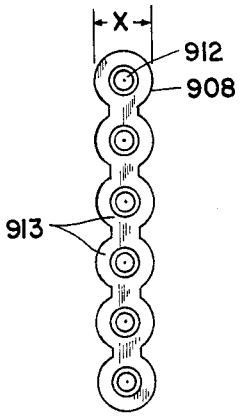
FIG. 9 is view of the fastener strip shown in FIG. 8.

Referring next to FIGS. 1 and 4–10, fastener feed assembly 900 is provided for supporting a strip of fasteners 902 (FIGS. 5 and 8), of the type disclosed in U.S. Pat. Nos. 4,106,618 and 4,106,619 to Haytayan, and for indexing the leading fastener 904 (FIG. 5) in the strip in position to be discharged by piston member 800. Strip of fasteners 902 comprises a plurality of fasteners 906, each of which is supported in a sleeve 908. The latter are secured together so as to form continuous strip 902. Each sleeve 908 has a predetermined outer diameter X (FIG. 9). Each fastener 906 has a head 910 and a shank 912. The specific configuration of fasteners 906 will vary depending upon the application for which the fastener is intended, as is well known in the art.

Fastener feed assembly 900 comprises a hollow fastener magazine 914 having a center wall 916, side walls 918 and 920, and a bottom wall 922. Side walls 918 and 920 and bottom wall 922 are attached to center wall 916 so as to extend normally therefrom. Side walls 918 and 920 are attached together at bottom wall 922. An elongate aperture 924 is provided in center wall 916. Aperture 914 extends along substantially the entire length of the wall 916. The width of aperture 924 is slightly greater than the cross-sectional diameter of fastener shank 912 and slightly less than the outside diameter X of fastener sleeves 908. A forward extension 925 (FIG. 1) is attached to bottom wall 922 of magazine 914 so as to extend forwardly therefrom a distance sufficient to ensure the front end of extension 925 lies along a plane intersecting barrel front end 976. The width of extension 925 is less than or equal to the width of barrel front portion 994, as described hereinafter.

Fastener feed assembly 900 includes a pusher 926 (FIG. 5) that is mounted for slidable movement in magazine 914. Pusher 926 comprises front slide plate 928 (FIG. 5), rear slide plate 930 (FIG. 1) and pusher plate 932 all joined to one another to form an integral unit. Pusher plate is supported at a right angle to front slide plate 428 and rear slide plate 930 and extends slidably through aperture 924 center wall 916. Front slide plate 928 slidably overlaps front surface 934 (FIG. 1) of center wall 916, and rear slide plate 930 slidably overlaps the rear surface 935 (FIG. 1) of center wall 916.

One end of a constant force spring 936 is attached to and coiled around a roller 937 that is rotatably mounted by a shaft 939 to pusher plate 932, the other end 938 of spring 936 is attached to an upper portion of side wall 920. Spring 936 tends to wrap itself further around roller 937, causing the roller to be urged toward the other end 938 of the spring. By this mounting, constant force spring 936 imparts an upward bias of constant force on pusher assembly 926 regardless of the position of the latter along aperture 924. When the pusher assembly is moved downwardly along aperture 924, constant force spring 936 unwinds from around itself.

Pusher 926 has a curved handle 944 (FIG. 1) attached to the bottom end of rear slide plate 930. Notch 946 (FIGS. 1 and 5) is provided in the front side of rear slide plate 930, and curved surface 948 (FIG. 1) is provided along the bottom of the handle. Pin 950 (FIGS. 1 and 5) is attached to and extends between side walls 918 and 920. Pin 950 is positioned so that when curved handle 944 is pulled downwardly away from the tool barrel 962, surface 948 will contact and be cammed outwardly by the pin so as to allow the latter to slip into notch 946. When pin 950 is disposed in notch 946, pusher assembly 926 is prevented from running back toward the tool barrel.

Figure 5:
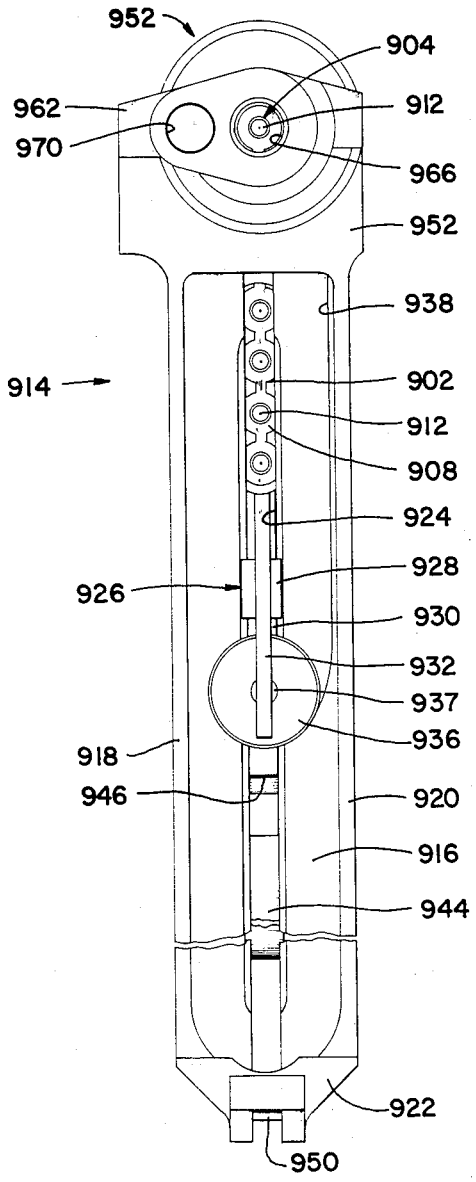
FIG. 5 is a front elevation view of the tool's barrel and fastener storage and feed assembly.
Figure 6:
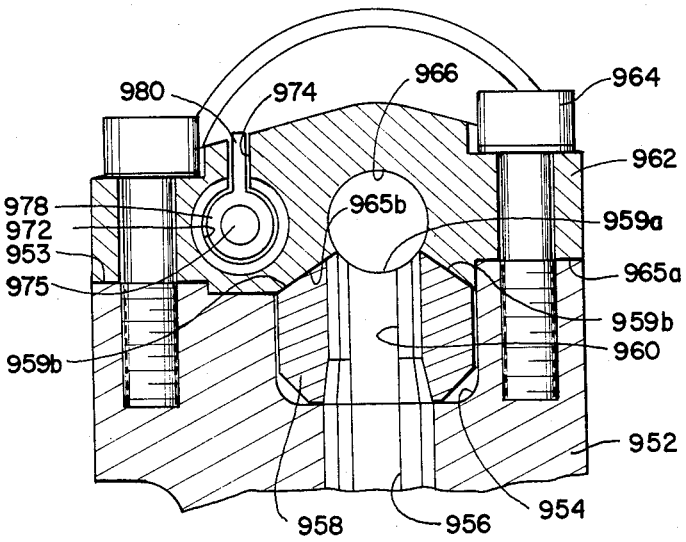
FIG. 6 is a cross section of the top portion of the barrel and fastener storage and feed assembly taken along line 6—6 in FIG. 1.
Figure 8:
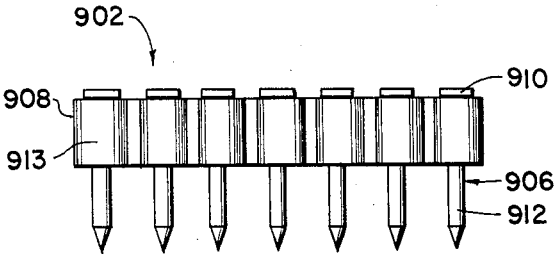
FIG. 8 is a side elevation of a fastener supporting strip used in conjunction with the present invention.
Figure 10:
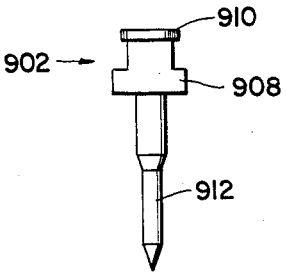
FIG. 10 is an end view of the fastener strip shown in FIG. 10.
Figure 7:
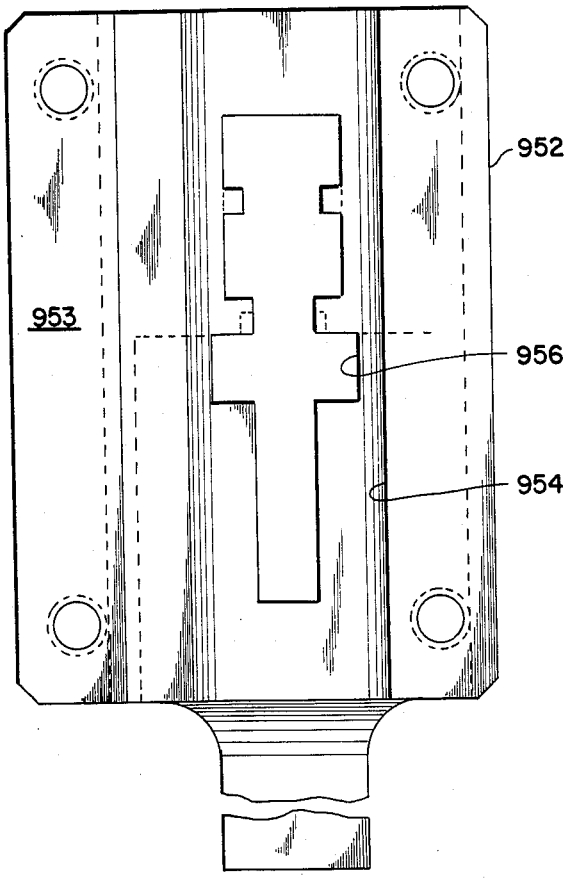
FIG. 7 is a plan view of the interior of the top portion of fastener storage and feed assembly.

Fastener housing 914 further comprises fastener feed chamber 952 (FIG. 5). The latter includes a top surface 953 (FIGS. 6 and 7). An elongate cavity 954 (FIGS. 6 and 7) is provided in feed chamber 952, and an aperture 956 is provided in the base of cavity 954 for coupling the latter with the space enclosed between magazine side walls 918 and 920. The cross section of aperture 956, as best seen in FIG. 7, corresponds in shape to the cross section of fastener strip 902, as best seen in FIG. 10, so that strip 901 can be driven up into and through aperture 956, as described hereinafter.

Face plate 958 (FIG. 6) is disposed in cavity 954 of feed chamber 952 and is sized to extend along substantially the entire length of cavity 954, with the result that face plate, 958 covers aperture 956. The top surface of face plate 958 comprises a curved trough-shaped portion **959*a* (FIG. 6) and sloping shoulder portions 959*b* (FIG. 6). An aperture 960 (FIG. 6) is provided in face plate 958, the cross section of which aperture is substantially identical to the cross section of aperture 956 in feed chamber 952. Face plate 958 is captivated in cavity 954 between feed chamber 952 and barrel member 962, as described in greater detail below, so as to ensure that aperture 960 remains aligned with aperture 956**.

Barrel member 962 is attached by set screws 964 to feed chamber 952. A bore 966 (FIG. 2) extends lengthwise through barrel member 962 and is positioned in coaxial alignment with housing bore 102. Barrel bore 966 is sized to receive piston shaft 802 with a close sliding fit. The barrel member also is provided with a slot 967 (FIG. 1) on its bottom side that intersects barrel bore 966. At slot 967, barrel member 962 has a bottom surface **965*a* that is contoured so as to make flush contact with fastener chamber top surface 953, and an inclined bottom surface 965*b* is configured to make flush contact with sloping shoulder portion 959*b* of face plate 958. The radius of curvature of block top surface 959*a* is substantially identical to the radius of barrel bore 966, so that when barrel member 962 is secured to fastener chamber 952, top surface 959*a* defines the bottom of an intermediate portion of barrel bore 966. Barrel bore 966 terminates at its rear end in a frusto-conical bore 969 (FIG. 22**).

A second bore 968 (FIGS. 2 and 6) extends through barrel member 962 in parallel with, but spaced from, barrel bore 966. This second bore 968 is coaxially aligned with shaft 632 disposed in cylinder groove 630. A large diameter threaded counterbore 970 (FIG. 2) is provided at the front of second bore 968 and smaller diameter counterbore 972 (FIG. 2) is positioned immediately behind the counterbore 970. An elongated hole 974 (FIG. 6) is provided in barrel member 962 so as to intersect counterbore 972. The length of hole 974 is approximately equal to the length of counterbore 972.

An elongate safety rod 975 (FIG. 2) is disposed in second bore 968. Safety rod 975 is sized so as to be easily slidable within second bore 968. Collar 978 (FIGS. 2 and 6) surrounds and is secured to rod 975 and is sized so as to make a close sliding fit in small counterbore 972. A finger 980 (FIG. 6) is attached to collar 978 so as to extend into elongate hole 974. Engagement of finger 980 with the opposite ends of hole 974 determines the length of possible movement of safety rod 975 in bore 968. Thus, the length of slot 974 determines the extent of axial movement of rod 975. A coiled compression spring 982 (FIG. 2) surrounds rod 974 and is captivated between collar 978 and shoulder 984 of counterbore 972. Threaded plug 986 is provided in large counterbore 970 for closing off the counterbore. The outer surface of plug 986 is threaded so as to permit the latter to be easily inserted into and removed from bore 970. Spring 982 urges safety rod 975 to its forward limit position. The length of safety rod 975 is set so that when it is in its forward limit position, its rear end is spaced from the forward end of cylinder and its forward end protrudes from the front end of the barrel, as shown in FIG. 1. Also when the safety rod is pushed further into the tool to its rear or retracted limit position, its rear end engages and pushes rod 632 back toward the breech block 500.

Barrel member 962 includes a reduced diameter cylindrical extension 988 (FIG. 2) at its rear end adjacent shoulder 990 that is sized to fit in cylinder bore 616. Barrel member 962 is threaded on its outer surface as shown at 992 adjacent the forward end of extension 988 so as to be connectable to threaded collar 624. Collar 624 coacts with thread 992 to lock the barrel and cylinder together with shoulder 990 engaging the cylinder front end 618.

Barrel member 962 further includes a front portion 994 that extends forwardly of fastener magazine 914 attached thereto. The width of front portion 994 and the distance front portion 994 extends forward of magazine 914 is selected so that front portion 994 can be inserted into a conventional U-shaped dry wall track to be secured to a floor or ceiling in either perpendicular or parallel relationship with the track, relative to the length of the latter. As noted above, the width of forward extension 925 of fastener magazine bottom wall 922 is less than or equal to the width of forward portion 994 so as to permit the extension 925 and portion 994 to be simultaneously inserted into a dry wall track.

The following description of the operation of the fastener driving tool of the present invention assumes the latter is in the "at rest" position illustrated in FIG. 1. To obtain this position, fastener feed assembly 900 is secured to cylinder assembly 600 by inserting threaded circular portion 992 into threaded collar 624 and then rotating the latter so as to draw shoulder 990 into contact with cylinder end 618. During this rotation, collar shoulder 626 and flange 622 coact so as to prevent the collar 624 from being pulled off the end of cylinder member 604 and so as to permit barrel member 962 to be securely attached to cylinder member 604. In this position, cylindrical barrel extension 988 extends into large diameter coaxial bore 616 so as to contact shock collar 806.

Further, in the at rest position, cylinder assembly 600 is disposed in housing bore 102 so that cylinder extension 606 and its counterbore 610 are coaxially aligned with breech block bore 504. Cylinder assembly 600 is also positioned so that stop pin 704 extends through cylinder slot 620 into bore 608.

To use the present fastener driver tool, a strip of fasteners 902 is inserted into fastener feed assembly 900 by pulling down on curved handle 944 against the bias of constant force spring 936. This downward movement causes constant force spring 936 to rotate about roller 937 and thereby unwind from around itself so as to permit pusher assembly 926 to slide downwardly along elongate groove 924. Curved handle 944 is pulled down until, by the camming engagement of its curved surface 948 with pin 950, the pusher assembly 926 is pivoted rearwardly slightly allowing pin 950 to drop into notch 946. When pin 950 is disposed in notch 946, pusher assembly 926 is releasably secured at the bottom of fastener magazine 914, in which position a strip of fasteners 902 can be readily inserted into the housing. Front and rear slide plates 928 and 930 are spaced apart from one another a distance sufficient to permit this pivotal movement of pusher assembly 926 relative to center plate 916.

Next, a strip of fasteners 902 is inserted into magazine 914 so that fastener shafts 912 extend through elongate aperture 924 and so that fastener sleeves 908 contact center wall rear surface 935 (FIG. 1). Shafts 912 are sized to extend through aperture 924 and the outer diameter or width X (FIG. 9) of sleeves 908 is selected to be greater than the width of elongate aperture 924 so that the sleeves cannot be pulled through the aperture.

Curved handle 944 is then pulled rearwardly so as to disengage pin 950 from notch 946. This disengagement allows constant force spring 936 to pull pusher assembly 926 upwardly until pusher plate 932 contacts the bottom fastener 906 and surrounding sleeve 908 in strip 902. Pusher plate 926, under the bias of constant force spring 936, urges strip 902 upwardly through aperture 956 (FIG. 6) in fastener feed chamber 952, aperture 960 (FIG. 6) in face plate 958, and barrel slot 967 into first bore 966 so that the leading fastener 904 is disposed in bore 966 in coaxial alignment with piston shaft 802.

A cartridge strip 302 is then inserted into aperture 116 so as to engage strip feed finger 312, as described in detail in the '380 patent.

As discussed in the '380 patent, a cartridge 304 positioned for firing in breech block assembly 500 cannot be discharged unless unitized firing pin 412 is urged rearwardly in housing bore 104 a distance sufficient to align latch 410 with trigger release lever protrusion 208. To achieve this alignment, a two-step procedure must be followed. First, barrel safety rod 975 (FIG. 2) must be urged into bore 968 against the bias of coil spring 982 until the front of the rod is flush with barrel front surface 976. Typically, this manipulation of safety rod 975 is achieved by moving front surface 976 into contact with a flat workpiece, e.g. a dry wall track to be secured to a floor or a ceiling. The width and length of barrel forward portion 994 and magazine forward extension 925 are selected so that portion 994 and extension 925 may be positioned between the legs of a conventional U-shaped dry wall track and brought into contact with the flat base of the U-shaped track.

The lengths of safety rod 975 (FIG. 2), shaft 632 (FIG. 2), and push rod 432 (FIG. 4) are selected, and safety rod 975, shaft 632 and push rod 432 are coaxially aligned with one another, so that when the front of rod 975 is moved rearwardly so as to lie along the plane of front surface 976, rod 975 contacts and urges shaft 632 rearwardly a selected distance. Shaft 632, in turn, contacts and urges push rod 432 rearwardly the same selected distance. Push rod 432, in turn, urges actuator housing 402 (FIG. 1), and latch 410 and unitized firing pin 412 disposed therein, rearwardly against the bias of springs 406 and 408 to a position in which latch 410 is slightly forward of trigger release lever protrusion 208.

In this position, the fastener-driver tool cannot be discharged because latch 410 is not aligned with release lever protrusion 208 of trigger assembly 200. As described in detail in the '380 patent, unitized firing pin 412 can be driven forwardly under the bias of spring 406 so as to fire a cartridge 304 disposed in breech block 500 only when latch 410 is moved upwardly out of engagement with firing pin notches 428 (FIG. 4) by release lever protrusion 208. Such movement of latch 410 is possible only when the latter is aligned with protrusion 208. Thus, safety rod 975 and shaft 632 comprise a first safety interlock assembly.

To achieve the alignment of protrusion 208 with latch 410, the second step in the two-step firing process must be performed. This second step involves urging cylinder assembly 600 rearwardly in housing bore 102 until the tool is in the "fire" position, i.e., when the rear end of cylinder member 604 is urged into contact with the front side of breech face plate 500 so as to close off its opening 507. Typically, the cylinder assembly 600 is moved into this position by pressing the tool forwardly against a workpiece.

When the front end of safety rod 975 is flush with front surface 976, movement of cylinder assembly 600 into the ready position drives push rod 432, and actuator housing 402 attached thereto, rearwardly so that latch 410 is aligned with trigger release lever protrusion 208. The lengths of push rod 432, shaft 632 and safety rod 975 are selected to ensure this alignment is achievable only when the above-described two-step process has been completed. Upon completion of the two-step process, the tool is ready for firing. In ordinary use of the present tool, the two steps of this process will be performed substantially simultaneously by pressing the tool firmly against the workpiece.

When cylinder assembly 600 is moved inside housing bore 102 from a forward position into the fire position, shoulders 621 of slot 620 slide along shoulders 705 of stop pin 704. Just before the fire position is reached, i.e. when the cylinder assembly 600 is in the position shown in FIG. 1, shoulders 705 will contact curved portions 623 of shoulders 621. Continued rearward movement of cylinder assembly 600 will permit curved portions 623 to slide along and force shoulders 705, and hence stop pin 704, downwardly a distance sufficient to permit piston head 804 of driver member 800 to pass over stop pin 704 without intercepting the stop pin.

As described in detail in the '380 patent, when cylinder member 604 is in the "fire" position, a cartridge 304 has been indexed by cartridge advance mechanism 300 into breech block assembly 500 immediately behind cylinder extension 606. Cartridge advance mechanism 300 is actuated to index a new cartridge 304 into breech block assembly 500, after the discharge of the old cartridge by the resultant forward movement of the rear portion of cylinder member 304 over cam surface 310, again, as described in detail in the '380 patent.

To discharge a fastener 906 from the tool, trigger 202 is depressed causing push rod 204 to drive release lever 206 upwardly against latch 410. This upward movement is transmitted through release lever protrusion 208 to latch 410 and causes the latter to disengage from notches 428 of unitized firing pin 412 so as to permit compression spring 408 to drive pin 412 forwardly, as described in detail in the '380 patent. This forward drive causes firing pin point 426 to pass through housing bore front portion 410 and into breech block bore 504 where the point contacts and rim fires the leading cartridge 304 in cartridge strip 302.

The discharge of cartridge 304 drives piston driver member 800 forwardly in cylinder coaxial bore 608, as described in detail in the '380 patent, and into barrel bore 966. Piston member 802 contacts the leading fastener 904 (FIG. 5) disposed in barrel bore 966 (FIG. 6) immediately above aperture 960 (FIG. 6) driving the fastener out of barrel member 962 and into the workpiece against which the tool has been positioned. Forward movement of piston member 800 is stopped when the head 912 of the discharged fastener contacts the workpiece, or if the workpiece does not offer sufficient resistance and the fastener is driven deeply into or entirely through the workpiece, when the front portion of piston head 804 contacts shock collar 806. The sleeve 908 surrounding the discharged fastener 904 is sheared off of the adjacent sleeve to which the former sleeve was attached when the fastener 904 is driven out of the tool by piston member 802.

The tool is then readied for another firing as follows. First, the tool is lifted away from its engagement with the workpiece, and the cylinder assembly 600 is disengaged from its contact with spent cartridge 304 and brought forward to the limit of aperture 620 either by pulling forward on fastener feed assembly magazine 914 or by "throwing" the tool in a forward motion with a snap of the wrist. This action causes cylinder assembly 600 to move forwardly in housing bore 102, whereby stop pin shoulders 705 are disengaged from curved portions 623 of slot shoulders 621, which disengagement in turn permits the compression spring of cylinder stop 700 to urge stop pin 704 upwardly into slot 620 so as to occupy the position illustrated in FIG. 1. In addition, this pulling or throwing forward action causes driver member 800 to return its head portion 804 into engagement with the rear portion of cylinder member 604, since cylinder member 604 will be moving forward within housing 100 and piston member 802 will be blocked from further forward movement by engagement of its head portion 804 with cylinder stop pin 704, so that the two parts once more occupy the position, relative to one another, shown in FIG. 1. At the same time, the movement of cylinder member 604 in a forward direction within housing 100 will allow cam member 308 to pivot about pin 309 thereby permitting cam finger 312 to engage cartridge strip 302.

Then, cylinder assembly 600 is brought back into the position shown in FIG. 1 by pushing rearwardly on fastener feed assembly housing 914. Piston assembly 800 moves rearwardly with cylinder assembly 600 due to the tight engagement of keeper ring 808 with cylinder bore 608. The return movement of cylinder assembly 600 causes cam 308 to pivot so as to discharge the spent cartridge and feed a new cartridge 304 into the firing position in breech block assembly 500, as described in detail in the '380 patent. When piston assembly 800 is driven rearwardly into cylinder member 604, as just described, piston shaft 802 moves rearwardly in barrel member 962 to a position rearward of aperture 956 (FIG. 7). As soon as aperture 956 is unblocked by piston shaft 802, pusher assembly 926, under the bias of constant force spring 936, moves upwardly in fastener magazine 914 and thereby drives fastener strip 902 upwardly until the new leading fastener 904 contacts the top edge of bore 966. In this position, the new leading fastener is ready to be discharged from the tool. At this point the fastener-driver tool has been returned to its "ready" position, as previously described. Subsequent firings are achieved by repeating the operation set forth above.

Advantages of the Invention

The present powder-activated fastener-driving tool described above offers a number of advantages over the prior art, including the tool of the '380 patent.

First, the present tool is significantly safer than other known fastener-driven tools, including the tool of the '380 patent, inasmuch as a fastener cannot be discharged from the present tool except when the barrel thereof is brought into contact with the workpiece and the cylinder assembly is moved rearwardly a selected distance within the tool housing. In typical prior art tools, a fastener can be discharged when only one of these two actions have been completed.

Second, fasteners can be dispensed more rapidly with the present tool than with the tool of the '380 patent. In the present tool, a group of fasteners can be stored and automatically positioned for discharge, whereas in the tool of the '380 patent fasteners must be inserted individually prior to each discharge.

Third, the firing pin actuator assembly and breech block assembly of the present tool are constructed so as to have fewer parts than the corresponding assemblies of the '380 tool. In the present invention, the firing pin contacts the cartridge directly, rather than contacting a separate firing point disposed in the breach block assembly, as in the tool of the '380 patent. Because fewer parts are used, the present tool is less expensive to produce than the '380 tool.

Fourth, the unitized firing pin of the present invention is more massive than the firing pin of the '380 patent. Due to its extra mass, the present unitized firing pin develops greater kinetic energy than the plural element firing pin of the '380 tool, which energy ensures the firing pin will be driven forwardly in a fashion minimizing, or practically eliminating, unfired cartridges. Also, with the unitized firing pin design, precise alignment is achieved with the leading end 426 of unitized firing pin 412 and a cartridge positioned in the firing position in breech block 500, which alignment also minimizes or practically eliminates the occurrence of unfired cartridges.

Fifth, unlike known fastener tools, the barrel front portion 994 and forward extension 925 of the tool of the present invention are sized to fit between the legs of a conventional U-shaped dry wall track. This sizing is advantageous inasmuch as it permits the barrel of the tool to be firmly engaged with the dry wall track prior to discharge of a fastener. This engagement ensures the fastener will be inserted in the dry wall track in the location desired with sufficient penetration to firmly attach the track to the ceiling or floor on which it is mounted.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a powder-actuated fastener-driving tool of the type comprising:

(a) a housing having a first opening therein;

(b) a barrel and cylinder assembly comprising a cylinder having a front end, a rear end, and a longitudinally-extending slot and a barrel having a back end and a muzzle end, with said back end of said barrel being secured to said front end of said cylinder so that said barrel and cylinder are coaxially aligned, said assembly being slidably disposed in said first opening and adapted for reciprocal movement in said housing between a rearward position and a forward position;

(c) a piston driver assembly disposed within said hollow barrel and cylinder member and adapted for reciprocal movement therein between a rear position and a forward position;

(d) a cylinder stop assembly mounted to said housing and comprising a yieldable stop means that projects into said slot so as to limit the longitudinal and rotational travel of said barrel and cylinder assembly relative to said housing;

(e) a breech block assembly mounted in said housing adjacent said barrel and cylinder assembly, said breech block assembly comprising a breech block having a central chamber and a longitudinally-extending bore that intersects said central chamber;

(f) firing means for firing a cartridge, said firing means comprising a firing actuator, movable means slidably supporting said actuator, spring means biasing said actuator and said movable means toward said breech block, latch means releasably locking said actuator to said movable means, and a push rod coupled to said movable means and extending through said breech block bore, said push rod being sized so that when the letter is driven rearwardly a selected distance it will cause said movable means to move away from said breech block to a first ready-fire position so as to store energy in said spring means, whereby said spring means can act to drive said actuator forward to fire a cartridge in said breech block when said actuator is released from said latch means;

(g) trigger means for operating said latch means so as to release said firing actuator from said movable means when the latter is in said first ready-fire position so as to permit said spring biasing means to bias said firing actuator toward said breech block; and (h) a cartridge advancing mechanism for advancing a strip of cartridges as said cylinder member is reciprocated so as to position a cartridge in firing position adjacent said cylinder member and said firing actuator;

the improvement wherein:

said fastener driver tool further comprises force-transmitting means movably disposed in said barrel and cylinder assembly for moving said push rod, said force-transmitting means being reciprocatable relative to said assembly and said housing between a first position in which a front portion of said force-transmitting means extends forwardly of said muzzle end of said barrel and a second position in which said front portion of said force-transmitting means is substantially flush with said muzzle end, said force-transmitting means being constructed and disposed so that (a) it moves said push rod rearwardly said selected distance only when (1) said barrel and cylinder assembly is in said rearward position and (2) said force-transmitting means is in said second position, and (b) movement of said force-transmitting means from said first position to said second position does not cause said barrel and cylinder assembly to move from said forward position toward said rearward position.

2. A tool as defined in claim 1, said barrel comprising a side port, further wherein said tool comprises fastener feed means releasably coupled to said barrel, said feed means comprising means for storing a plurality of fasteners and means for automatically inserting fasteners one by one into said barrel via said side port, so that said piston driver can contact and propel successive fasteners from said barrel when said piston driver moves from its said rear position to its said forward position.

3. A tool as defined in claim 2 wherein said fastener feed means comprises:

magazine means coupled with said barrel at said side port for supporting said plurality of fasteners for slidable movement along path that extends through said side port;

pusher means mounted for reciprocal sliding movement along said path for driving said fasteners along said path so that a leading one of said fasteners can pass through said side port into said barrel; and spring means for urging said pusher means along said path toward said side port with a substantially constant force regardless of the position of said pusher means on said path.

4. A tool as defined in claim 3 further including a handle means attached to said pusher means for enabling a user to move said pusher means along said path, and lock means for releasably securing said pusher means at a selected position on said path distal from said barrel opening.

5. A tool as defined in claim 1 wherein said force transmitting means comprises:

a longitudinally-extending groove in the outer surface of said cylinder member positioned in coaxial alignment with said push rod, said groove extending to the rear end of said cylinder member so as to be able to receive the forward end of said push rod;

a force-transmitting shaft slidably disposed in said groove;

a longitudinally-extending bore in said barrel member extending substantially the entire length of said barrel member and positioned in coaxial alignment with said cylinder member groove;

a safety actuating rod slidably disposed in said barrel bore;

means for biasing said safety actuating rod forwardly so that the front end thereof projects from the muzzle end of said barrel member;

the size of said force-transmitting shaft and said safety actuating rod being selected so that when (1) said barrel and cylinder assembly is in said rearward position, and (2) said safety actuating rod is urged rearwardly so that its front end is flush with said barrel muzzle end, said force transmitting shaft is forced rearwardly by said safety actuating rod far enough to force said push rod rearwardly said selected distance.

6. A tool as defined in claim 1 wherein said force-transmitting means comprises:

a longitudinally-extending groove in the outer surface of said cylinder member positioned in coaxial alignment with said push rod, said groove extending to the rear end of said cylinder member so as to be able to receive the forward end of said push rod; and an elongated shaft slidably disposed in said groove, said shaft being sized and positioned to move into contact with and propel said push rod rearwardly said selected distance only when said barrel and cylinder assembly is shifted to said rearward position and said force-transmitting means is shifted to said second position.

7. A tool according to claim 1 wherein said force-transmitting means directly engages said push rod when said force-transmitting means id shifted to said second position.

8. In a powder-actuated fastener tool of the type comprising:

(a) housing having a first opening therein;

(b) a barrel and cylinder assembly disposed in said first opening and adapted for reciprocal movement in said housing between a rearward position and a forward position, said barrel and cylinder assembly comprising (1) a hollow barrel having a front end and (2) a hollow cylinder member having a front end, a rear end and a first longitudinally-extending slot;

(c) a piston driver assembly disposed within said hollow cylinder assembly and adapted for reciprocal movement therein between a rear position and a forward position;

(d) a cylinder stop assembly mounted to said housing and comprising a yieldable stop means that projects into said slot so as to limit the longitudinal and rotational travel of said barrel and cylinder assembly relative to said housing;

(e) a breech block assembly mounted in said housing adjacent said barrel and cylinder assembly, said breech block assembly comprising a breech block having a central chamber and a longitudinally-extending bore that intersects said central chamber;

(f) firing means for firing a cartridge, said firing means comprising a firing actuator, movable means slidably supporting said actuator, spring means biasing said actuator and said movable means toward said breech block, latch means releasably locking said actuator to said movable means, and a push rod coupled to said movable means and extending through said breech block bore, said push rod being sized so that when [it]the latter is driven rearwardly a selected distance it will cause said movable means to move away from said breech block to a first ready-fire position so as to store energy in said spring means, whereby said spring means can act to drive said actuator forward to fire a cartridge in said breech block when said actuator is released from said latch means;

(g) trigger means for operating said latch means so as to release said firing actuator from said movable means when the latter is in said first ready-fire position so as to permit said spring biasing means to bias said firing actuator toward said breech block; and (h) a cartridge advancing mechanism for advancing a strip of cartridges as said cylinder member is reciprocated so as to position a cartridge in firing position adjacent said cylinder member and said firing actuator;

(i) fastener feed means releasably coupled to said barrel, said feed means comprising means for storing a plurality of fasteners and means for automatically inserting fasteners one by one into said barrel via said side port, so that said piston driver can contact and propel successive fasteners from said barrel when said piston driver moves from its said rear position to its said forward position;

the improvement comprising:

quick release means for releasably coupling said barrel with said cylinder so that said barrel can be quickly and easily attached to or detached from said cylinder, said quick release means being designed to prevent said barrel from (1) rotating about its long axis relative to said cylinder when said barrel is secured to said cylinder and (2) moving along its axis relative to said cylinder when said barrel is attached to said cylinder, said quick release means comprising:

(a) a threaded exterior surface on said barrel;

(b) collar means, including a threaded collar rotatably mounted on said front end of said cylinder, for engaging said threaded exterior surface of said barrel and for causing said barrel to move onto engagement with said cylinder when said collar is rotated with respect to said cylinder so as to releasably attach said barrel to said cylinder.

9. A tool as defined in claim 8, further wherein said barrel comprises a forward portion that extends forwardly of said feed means, and wherein said front end is located at the front of said forward portion, further wherein said forward portion is sized to fit between the legs of a conventional U-shaped dry wall track so as to permit said front end to be engaged with the base of said dry wall track.

10. In a powder-actuated fastener tool of the type comprising:

(a) a housing having a first opening therein;

(b) a barrel and cylinder assembly disposed in said first opening and adapted for reciprocal movement in said housing between a rearward position and a forward position, said barrel and cylinder assembly comprising (1) a hollow barrel having a front end and a side port, and (2) a hollow cylinder member having a front end, a rear end and a first longitudinally-extending slot;

(c) a piston driver assembly disposed within said hollow barrel and cylinder assembly and adapted for reciprocal movement therein between a rear position and a forward position;

(d) a cylinder stop assembly mounted to said housing and comprising a yieldable stop means that projects into said slot so as to limit the longitudinal and rotational travel of said barrel and cylinder assembly relative to said housing;

(e) a breech block assembly mounted in said housing adjacent said barrel and cylinder assembly, said breech block assembly comprising a breech block having a central chamber and a longitudinally-extending bore that intersects said central chamber;

(f) firing means for firing a cartridge, said firing means comprising a firing actuator, movable means slidably supporting said actuator, spring means biasing said actuator and said movable means toward said breech block, latch means releasably locking said actuator to said movable means, and a push rod coupled to said movable means and extending through said breech block bore, said push rod being sized so that when the latter is driven rearwardly a selected distance it will cause said movable means to move away from said breech block to a first ready-fire position so as to store energy in said spring means, whereby said spring means can act to drive said actuator forward to fire a cartridge in said breech block when said actuator is released from said latch means;

(g) trigger means for operating said latch means so as to release said firing actuator from said movable means when the latter is in said first ready-fire position so as to permit said spring biasing means to bias said firing actuator toward said breech block;

(h) a cartridge advancing mechanism for advancing a strip of cartridges as said cylinder member is reciprocated so as to position a cartridge in firing position adjacent said cylinder member and said firing actuator; and (i) fastener feed means, releasably coupled to said barrel, for storing a plurality of fasteners and for automatically inserting fasteners one by one into said barrel via said side port so that said piston driver can contact and propel successive fasteners from said barrel when said piston driver moves from its said rear position to its said forward position;

the improvement wherein said fastener feed means further comprises:

a fastener storage and feed assembly having (a) an elongate passageway sized to receive a plurality of fasteners (b) an opening coupled with said passageway through which said plurality of fasteners can be inserted into and discharged from said passageway, and(c) a selectively-sized counterbore chamber coupled with said passageway and said opening, said assembly being releasably attached to said barrel so that said counterbore chamber is in direct communication with said side port of said barrel; and a face plate having an aperture extending therethrough sized so that said plurality of fasteners will slide freely through said aperture, said face plate being captivated in said counterbore chamber and being sized to be easily removable from said counterbore chamber when said fastener feed means is not coupled to said barrel, said aperture being positioned in said face plate so that the former is aligned and in communication with said passageway when said face plate is captivated in said counterbore chamber so that said plurality of fasteners can be fed from said passageway through said aperture and into said side port.

11. In a powder-actuated fastener tool of the type comprising:

(a) a housing having a first opening therein;

(b) a barrel and cylinder assembly disposed in said first opening and adapted for reciprocal movement in said first opening between a rearward position and a forward position, said barrel and cylinder assembly comprising (1) a hollow barrel having a front end and a side port, and (2) a hollow cylinder member having a front end, a rear end a first longitudinally-extending slot;

(c) a piston driver assembly disposed within said hollow barrel cylinder assembly and adapted for reciprocal movement therein between a rear position and a forward position;

(d) a cylinder stop assembly mounted to said housing and comprising a yieldable stop means that projects into said slot so as to limit the longitudinal and rotational travel of said barrel and cylinder assembly relative to said housing;

(e) a breech block assembly mounted in said housing adjacent said barrel and cylinder assembly, said breech block assembly comprising a breech block having a central chamber and a longitudinally-extending bore that intersects said central chamber;

(f) firing means for firing a cartridge, said firing means comprising a firing actuator, movable means slidably supporting said actuator, spring means biasing said actuator and said movable means toward said breech block, latch means releasably locking said actuator to said movable means, and a push rod coupled to said movable means and extending through said breech block bore, said push rod being sized so that when the latter is driven rearwardly a selected distance it will cause said movable means to move away from said breech block to a first ready-fire position so as to store energy in said spring means, whereby said spring means can act to drive said actuator forward to fire a cartridge in said breech block when said actuator is released from said latch means;

(g) trigger means for operating said latch means so as to release said firing actuator from said movable means when the latter is in said first ready-fire position so as to permit said spring biasing means to bias said firing actuator toward said breech block;

(h) a cartridge advancing mechanism for advancing a strip of cartridges as said cylinder member is reciprocated so as to position a cartridge in firing position adjacent said cylinder member and said firing actuator;

(i) fastener feed means, releasably coupled to said barrel, for storing a plurality of fasteners and for automatically inserting fasteners one by one into said barrel via said side port so that said piston driver can contact and propel successive fasteners from said barrel when said piston driver moves from its said rear position to its said forward position;

the improvement wherein said fastener feed means further comprises:

a magazine coupled with said barrel at said side port for supporting said plurality of fasteners for slidable movement along a path that extends through said side port;

a pusher mounted to said magazine for reciprocal sliding movement along said path for urging a leading one of said plurality of fasteners can pass through said side port into said barrel; and a constant force spring assembly for urging said pusher means along said path toward said side port with a substantially constant force regardless of the position of said pusher means on said path, said constant force spring assembly comprising (a) a flat, elongate spring having a first end and a second end, said spring being biased to coil about said first end, and (b) a hub secured to said pusher so as to be movable therewith along said path, said first end of said spring being secured to said hub and said second end of said spring being secured to said magazine adjacent said side port so that said spring coils around said hub as said pusher moves toward said side port of said barrel.

* * * * *